US005490811A

United States Patent [19]

Hosokawa

[11] Patent Number: 5,490,811

[45] Date of Patent: Feb. 13, 1996

[54] APPARATUS FOR CHAMFERING NOTCH OF WAFER

[75] Inventor: Kaoru Hosokawa, Saitama, Japan

[73] Assignee: Shin-Etsu Handotai Co., Ltd., Tokyo, Japan

[21] Appl. No.: 70,623

[22] Filed: Jun. 2, 1993

Related U.S. Application Data

[63] Continuation-in-part of Ser. No. 897,038, Jun. 11, 1992, Pat. No. 5,271,185.

[30] Foreign Application Priority Data

Jun. 12, 1991 [JP] Japan ..... 3-167753

[51] Int. Cl.[6] ..... B24B 9/06

[52] U.S. Cl. ..... 451/239; 451/44

[58] Field of Search ..... 51/100 R, 101 R, 51/283 R, 283 E, 284 E, 101 LG, 106 R, 51; 451/237, 239, 41, 44, 43, 240, 254, 146

[56] References Cited

U.S. PATENT DOCUMENTS

| | | | |
|---|---|---|---|
| 3,815,288 | 6/1974 | Wilson | 51/101 R |
| 3,864,878 | 2/1975 | Ledebur et al. | 51/101 R |
| 4,167,836 | 9/1979 | Takishima | 451/276 |
| 4,905,425 | 3/1990 | Sekigawa et al. | 51/283 E |
| 5,009,038 | 4/1991 | Yoshikawa et al. | 51/101 R |
| 5,036,624 | 8/1991 | Steere, Jr. | 51/34 C |
| 5,185,965 | 2/1993 | Ozaki | 51/283 E |

FOREIGN PATENT DOCUMENTS

| | | |
|---|---|---|
| 2180554 | 7/1990 | Japan . |
| 1238963 | 11/1968 | United Kingdom . |

*Primary Examiner*—Robert A. Rose
*Attorney, Agent, or Firm*—Townsend & Banta

[57] ABSTRACT

A method and apparatus is provided for chamfering a notch of a wafer by controlling the operation of a disc shaped rotational grandstone by means of a profiling control mechanism, including a holding and rotation mechanism for rotating the wafer around the central axis normal to a principal surface of the wafer within a predetermined range of angle; a reference plate having a diameter and a thickness the same as a similar enlargement of the wafer and a chamfering guide surface the same as a similar enlargement of a surface to be formed on the notch by the chamfering at the same enlargement factor as the reference plate; and a disc having a predetermined diameter and a predetermined thickness. The method comprises fixing the wafer to the holding and rotation mechanism; rotating the wafer within the predetermined range and the reference plate within the same range, moving the disc in the thickness direction of the reference plate and the direction parallel to a surface of the reference plate in order that the outer periphery of the disc makes contact with the reference plate; detecting the direction and the amount of the motion of the disc making contact with the chamfering guide surface; decreasing detected data by a factor of the inverse of an enlargement factor; and chamfering the notch of the wafer by contacting the outer periphery of the grindstone with the notch in accordance with decreased data.

5 Claims, 4 Drawing Sheets

APPARATUS FOR CHAMFERING NOTCH OF WAFER

BACKGROUND OF THE INVENTION

This is a continuation-in-part of U.S. application Ser. No. 07/897,038 filed on Jun. 11, 1992, now U.S. Pat. No. 5,271,185.

FIELD OF THE INVENTION

This invention relates to an apparatus for chamfering a notch of a semiconductor wafer, which performs the chamfering work of the notch while keeping the wafer rotating around the central axis perpendicular to the main surface thereof. More particularly, this invention relates to a chamfering apparatus which is furnished with a profiling mechanism to be operated specifically in the chamfering work.

DESCRIPTION OF THE PRIOR ART

On account of effective application of photolithography, it has been customary for wafers such as semiconductor wafers to have an orientation flat (hereinafter referred to as "OF") formed thereon by grinding off to leave a short linear cut in part of the periphery of a wafer thereby facilitating correct positioning of the wafer on an exposure device.

The formation of the OF, however, inevitably results in removal of a large portion of the wafer. Particularly in the production of wafers of a large diameter, the cumulative amount of portions wasted by this removal is so large as to impair the yield of products conspicuously. The fact that this impaired yield prevents expensive semiconductor wafers from being efficiently utilized has posed a problem.

In the circumstances, the practice of imparting a notch substantially in the shape of the letter V or substantially in the shape of an arc to the periphery of a given wafer has come to prevail for the purpose of efficiently utilizing produced wafers. Particularly the V-shaped notches have been finding extensive utility by reason of their outstanding accuracy of positioning.

Since the wafers are destined to be conveyed a number of times on production lines as in the process for manufacture of devices, their peripheries are possibly subject to chippings on colliding with parts of equipment used in the manufacturing process and the produced semiconductor devices consequently suffer from degradation of characteristic properties. It has been customary, therefore, for the wafers to have their peripheral parts chamfered.

The wafers furnished with a notch as described above, however, have found on adaptability for any work of conventional chamfering technique because the notch is small in size as compared with the peripheral length of a wafer. As the semiconductor IC's have gained in number of components per chip, however, there come to entail the drawback that the notch of their wafers causes chippings when the wafers are positioned in the process of device production by aligning the notches to a pin of rigid material. Since sharp edges of the wafers are not easily removed by machining, the sharp edges conspicuously increase occurrence of dust and the effort to preclude chipping fails. This fact has posed a problem to serious to be ignored.

This invention, initiated in the light of this problem, has as an object the provision of an apparatus for chamfering a notch of a wafer, which apparatus is capable of easily and accurately chamfering a sharp edge such as of the notch and enabling the work of chamfering the notch to be carried out in high efficiency. Moreover, this apparatus enjoys simplicity of construction.

SUMMARY OF THE INVENTION

To accomplish the object described above, this invention contemplates an apparatus which is characterized by being provided with a rotary disk grindstone, a wafer retaining mechanism for disposing the surface of a wafer so as to intersect the surface of the grindstone, a first drive mechanism capable of rotating the wafer within a prescribed range of angle around the central axis perpendicular to the main surface of the wafer thereby continuously positioning the surface of a notch of the wafer subjected to the grinding relative to the grinding surface of the grindstone and effecting required grinding, a second drive mechanism capable of causing the grindstone and to be relatively moved forward and backward in the radial direction of the grindstone, a third drive mechanism capable of causing the grindstone and wafer to be relatively moved upward and downward in the direction of thickness of the wafer, and a profiling mechanism capable of relatively guiding the notch and grindstone and consequently chamfering the notch in the circumferential direction and/or in the direction of wall thickness thereof.

DETAILED DESCRIPTION OF THE PREFERRED EMBODIMENTS

In the apparatus of this invention for chamfering the notch of a wafer which is constructed as described above, the wafer is rotated within a prescribed range of angle as the first to third drive mechanism are operated and the grindstone and wafer are consequently moved relatively in the direction approaching to or separation from each other through the medium of the profiling mechanisms. As a result, the surface of the notch subjected to grinding can be continuously and accurately positioned relative to the grinding surface of the grindstone under the guiding action of the profiling mechanism and the chamfering work can be carried out accurately and efficiently on the notch in the circumferential direction and/or in the direction of wall thickness thereof.

The profiling mechanism can select the reference plate and guide surface and desired shape and in accordance with size the figure of the notch such as a V or a semi-circle, as well as the shape of the chamfer of the notch to be chamfered. This reference plate and a disk identical in diameter with the grindstone can be produced by precision machining of hard metal. Though this invention is directed to a method and apparatus for chamfering the notch of a wafer which has already undergone the notching work and has the inner periphery of the notch left yet unchamfered, it may be embodied in machining a wafer which has undergone no notching work and producing a wafer furnished with a notch.

The apparatus of this invention for chamfering the notch of a wafer will be described below with reference to the accompanying drawings illustrating an embodiment of this invention.

Figure 1:
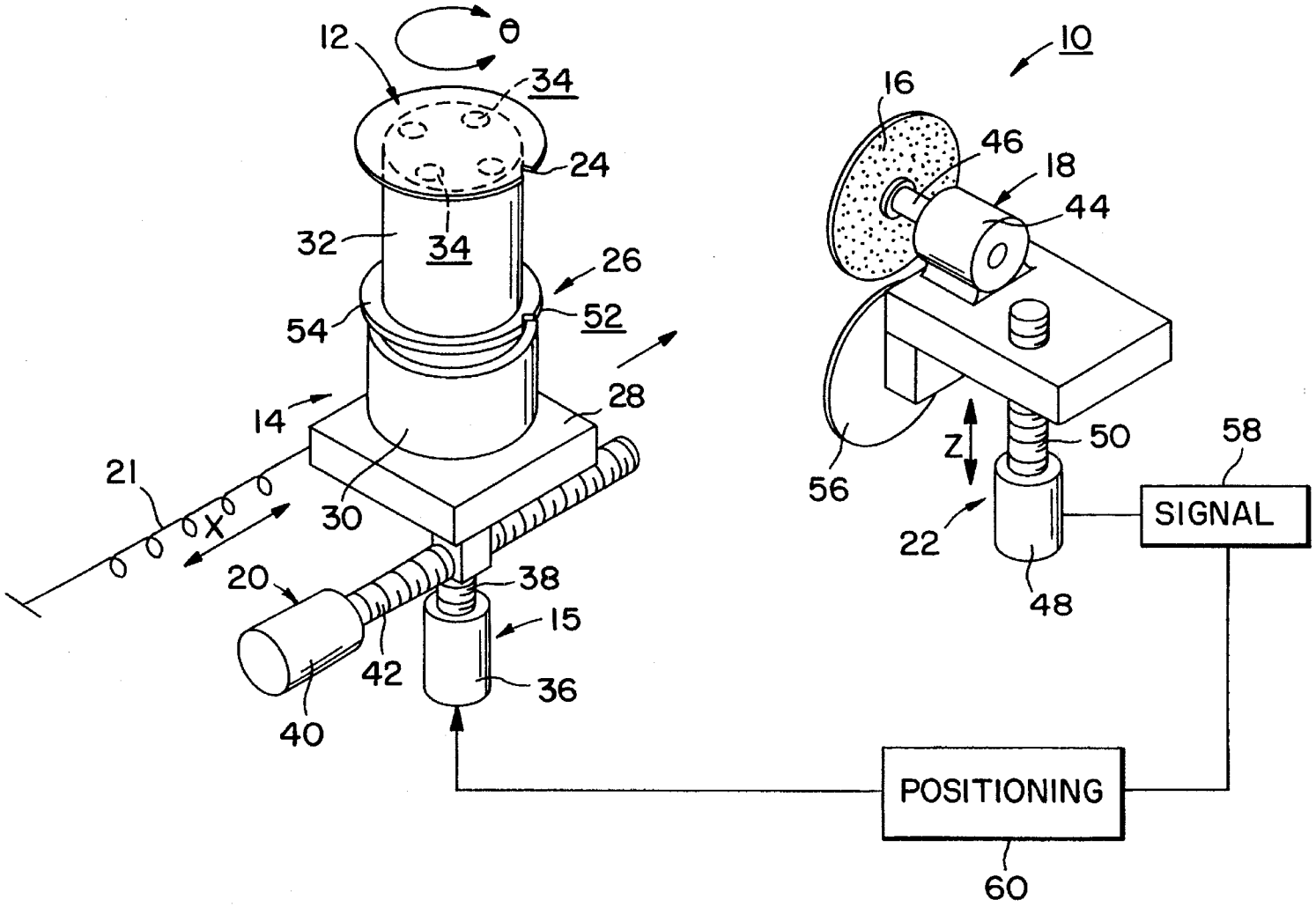
FIG. 1 is a perspective explanatory diagram of an apparatus for chamfering a notch of a wafer as an embodiment of this invention.
Figure 2:
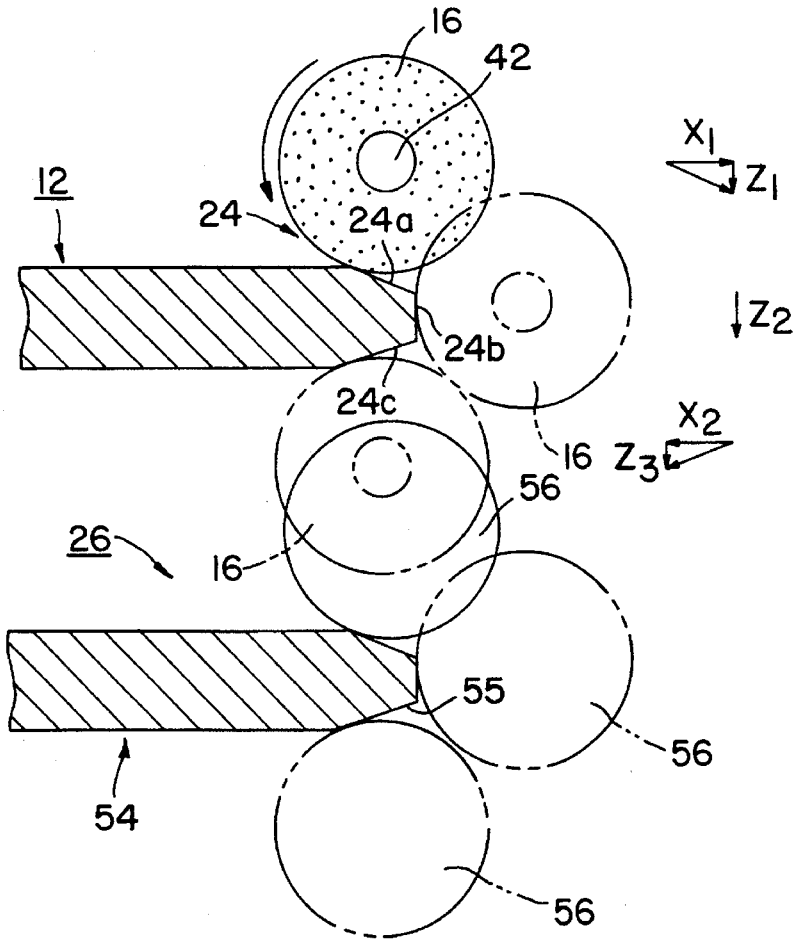
FIG. 2 is an explanatory diagram illustrating a chamfering work being performed in the direction of inside wall thickness of the notch.

In FIG. 1, the reference numeral 10 stands for an apparatus for chamfering the notch as an embodiment of this invention. This notch chamfering apparatus 10 is provided with a wafer retaining mechanism 14 for retaining a wafer 12 in a given posture, a first drive mechanism 15 for rotating this wafer 12 within a predetermined range of angle around the central axis perpendicular to the main surface of the wafer (in the direction indicated by the arrow Θ), a rotary drive mechanism 18 which positions a grindstone 16 of the shape of a disk in such a manner that the surface thereof intersects the surface of the wafer 12 (perpendicularly intersects in this embodiment), a second drive mechanism 20 provided on the wafer retaining mechanism 14 for the purpose of moving the grindstone 16 and wafer 12 relatively forward and backward in the radial direction of the grindstone 16 (in the direction indicated by the arrow X), a third drive mechanism 22 provided on the rotary drive mechanism 18 for the purpose of moving the grindstone 16 and wafer 12 relatively forward and backward in the direction of thickness of the wafer 12 in the direction indicated by the arrow Z), and a profiling mechanism 26 for relatively guiding a notch 24 of the wafer 12 and the grindstone 16 and performing a chamfering work on the notch in the circumferential direction and/or in the direction of thickness thereof. Preferably, the grindstone 16 is selected to be thinner than the dimension of a notch in wafer 12. The profiling mechanism 26 comprises a reference plate 54 possessing a groove corresponding to the wafer notch subjected to chamfering work and a disk 56 adapted to be guided by having the peripheral edge thereof held in contact with a curved chamfering part guiding surface 55 of the reference plate 54 (FIG. 2).

The wafer retaining mechanism 14 is proved with a base stand 28 to which is attached spring 21 to urge base stand 28 backward and forward along the X axis. This base stand 28 is provided with a cylindrical part 30. A rotary base 32 is seated on this cylindrical part 30. On the upper end surface of this rotary stand 32, are formed a plurality of suction holes 34 communicating with a vacuum pump not shown in the diagram and serving to attract the wafer 12 by suction. The first drive mechanism 15 is provided with a pulse motor 36 in the form of a servomotor. A feed screw 38 is connected to the pulse motor 36 and this feed screw is joined coaxially to the rotary stand 32.

The second drive mechanism 20 is provided with a pulse motor 40. A feed screw 42 connected to the rotary shaft of this pulse motor is coupled with the wafer retaining mechanism 14. The rotary drive mechanism 18 is provided with an electric motor 44. To a rotary shaft 46 of this electric motor 44, the grindstone 16 is rotatably fixed. To this rotary drive mechanism 18 is joined to feed screw 50 which is connected to a pulse motor 48 serving as a component for the third drive mechanism 22.

The profiling mechanism 26 has the shape of a disk conforming to the wafer 12 and is provided with the reference plate 54 having a groove 52 formed therein so as to conform to the notch 24 and the disk 56 possessing a shape corresponding to the grindstone 16 and permitting adjustment of position. This reference plate 54 is provided with the guiding surface 55 curved along the direction of thickness of the wafer 12 (the direction indicated by the arrow Z) (FIG. 2). The reference plate 54 is set detachably to the rotary base 32 and the disk 56 is fixed detachably to the rotary drive mechanism 18 parallel to the grindstone 16. The profiling mechanism 26 can be conformed to various shapes of the notch 24 by selecting the shape of the reference plate 54 and disk 56. In the profiling mechanism 26, the base stand 28 of the wafer retaining mechanism 28 is urged in a fixed direction along a guide not shown in the diagram, specifically in the driving direction X of the second drive mechanism 20, for example, by virtue of a spring or weight not shown in the diagram so that the disk 56 and the reference plate 54 may maintain mutual contact at a part thereof in a desired direction of thickness and at a desired angle of rotation of the reference plate 54.

The stepping motor 36 has a control input from positioning mechanism 60 which causes the shaft 38 to rotate throughout the angle Θ. The positioning mechanism 60 also has an output which is sent to a signal generating means 58 and then to motor 48. The signal from signal generating means 58 to motor 48 moves the shaft 50 which runs the profiling mechanism up and down in the Z axis. Coordinated movement of the motor 48 and the motor 36 is provided for profiling of the wafer 12 as wheel 56 follows the reference plate 54. Any combination of signals may be used to motors 36 and 48 such as rotation of the wafer 12 about a 360° angle theta while motor 48 is stationary, thereby cutting a circular track around the wafer except for where the guide wheel 56 enters the notch. As an alternative, the motor 48 can be cycled upwards and downwards to correspond to each step of the motor 36, thereby providing cutting around the wafer edge at each position of motor 36 and each angle theta.

Since motor 36 and motor 48 are both stepping motors, those skilled in the art can easily recognize that a coordinated control must be applied to each motor in order to accomplish grinding of the wafer 12 by wheel 16.

Now, the operation of the notch chamfering apparatus 10 constructed as described above will be described.

First, the wafer 12 of the shape of a disk is set in place on the rotary stand 32 as one component of the wafer retaining mechanism 14 and is attracted to the rotary stand 32 through the medium of the suction holes 34 by virtue of the suction effected with a vacuum pump not shown in the diagram. Here, the angular position of the wafer 12 or the angular position of the reference plate 54 is adjusted by virtue of positioning means not shown in the diagram so that the notch 24 of this wafer 12 is aligned to the grove 52 of the reference plate 54. After the notch 24 of the wafer 12 and the grindstone 16 have been disposed at prescribed positions allowing perpendicular intersection of their respective surfaces, the first drive mechanism 15 to the third drive mechanism 22 are selectively or synchronously driven and controlled by a positioning means.

At this time, the second drive mechanism 20 is utilized for adjusting the relative positions of the wafer 12 and the grindstone 16 in the X direction. In the notch chamfering work performed in this invention with the profiling mechanism, the spring 21 or weight not shown in the diagram and the guide mechanism not shown in the diagram cooperate to move the base stand 28 in the direction indicated by the arrow X with part of the peripheral edge of the disk 56 pressed in the direction indicated by the arrow X, constantly against a curved chamfer of the groove guiding surface 55 of the reference plate 54. The first drive mechanism 15 rotates the rotary stand 32 at a given rotational speed in the direction indicated by the arrow Θ through the medium of the feed screw 38 under the action of the pulse motor 36. In the meantime, the grindstone 16 is rotated through the medium of the rotary shaft 46 under the driving action of the electric motor 44. As a result, the wafer 12 and the grindstone 16 in rotation are relatively moved toward or away from each other and the wafer 12 is rotated in the direction indicated by the arrow Θ and the chamfering work is performed in the circumferential direction of an angular part 24*a* of the notch 24 (FIG. 2).

The grindstone 16, while performing the chamfering work in the direction of length of the inner periphery of the angular part 24*a* of the notch 24, is moved as shown in FIG. 2 at a relatively low speed in the direction of the arrow along the angular part 24*a*. To be specific, when a signal to drive is input into the pulse motor 48 as a component of the third drive mechanism 22, the feed screw 50 is rotated in a direction through the medium of this pulse motor 48 and the rotary drive mechanism 18 joined to this feed screw 50 is slowly moved in the direction of the arrow $Z_1$. At the same time, the profiling mechanism 26 adjusts the positional relation between the reference plate 54 and the disk 56 while keeping the circumferential edge of the disk 56 in constant contact with the curved guiding surface 55 of the reference plate 54, with the result that the grindstone 16 and the wafer 12 are relatively moved in the direction of the arrow $X_1$ and the grindstone 16 is positioned relative to the angular part 24*a*. After the chamfering work covering a limited minimal width in the direction of length of the inner periphery of the angular part 24*a* has been completed as described above, therefore, the chamfering work is continuously repeated with next minimal width in the direction of length of the inner periphery of the angular part 24*a*.

Since the grindstone 16 performs the chamfering work on the angular part 24*a* continuously across successive widths of a given minimal size as described above, the possibility of this angular part 24*a* being machined so as to give rise to a slightly depressed surface conforming to the shape of the grindstone 16 in case of a stepwise movement of the grindstone 16 is nil. The angular part 24*a* is ideally ground in the shape of a flat surface or in the shape of even a curved surface containing slightly outward R's in the cross section taken in the direction of wafer thickness. The question as to whether the chamfer is obtained in the shape of a flat surface or in the shape of a curved surface containing outward R's in the cross section taken in the direction of thickness of the wafer is freely decided by selecting the design shape of the profiling mechanism.

Subsequently, the outermost peripheral surface part 24*b* and the angular part 24*c* of the wafer 12 are continuously ground similarly in a plurality of working rounds, one for each of the successive widths of the predetermined size mentioned above. Here, the grindstone 16 is moved in the direction of the arrow $Z_2$ while the machining is in process on the outer peripheral part 24*b* which is perpendicular to the main surface of the wafer 12. While the machining is in process on the angular part 24*c*, the grindstone 16 and the wafer 12 are relatively moved in the directions of the arrows $X_2$ and $Z_3$. As a result, the chamfering work of the wafer 12 in the circumferential direction and in the direction of wafer thickness is continuously and efficiently carried out.

In this embodiment, the reference plate 54 and the disk 56 which are components of the profiling mechanism 26 are disposed on the rotary stand 32 for retaining the wafer 12 and the rotary drive mechanism 18. Under the guiding actions of the reference plate 54 and the disk 56, therefore, the wafer 12 and the grindstone 16 can be accurately and easily positioned. The arrangement has an effect of enabling the chamfering work of this wafer 12 to be carried through efficiently.

Particularly noteworthy is the fact that the wafer 12 and the grindstone 16 are so disposed that the respective surfaces thereof perpendicularly intersect and the reference plate 54 as a component of the profiling mechanism 26 has therein a groove 52 conforming to the shape of the notch 24. It has an advantage in that the surface of the notch 24 which is appreciably small as compared with the size of the wafer 12 can be continuously and accurately positioned for the sake of chamfering relative to the grinding surface of the grindstone 16 by simply fitting the disk 56 to the groove 52 of the reference plate 54 and, consequently, the notch 24 can be chamfered with high accuracy by a conspicuously simplified operation.

Figure 3:
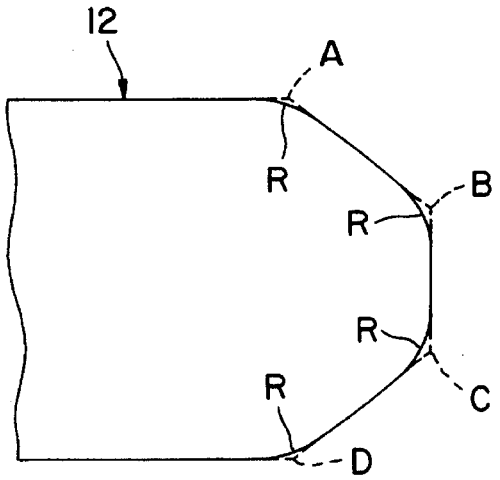
FIG. 3 is an explanatory diagram illustrating the notch which has undergone the chamfering work.

After the notch 24 has been chamfered, angular parts A to D (indicated by a broken line in FIG. 3) are formed and these angular parts A to D are liable to sustain chippings. In this embodiment, the reference plate 54 possesses the guide surface 55 which is curved along the direction of thickness of the wafer 12. Owing to the provision of this guide surface 55, the angular parts A to D can be very easily furnished with an R (indicated by a solid line in the diagram) without requiring any complicated control.

Figure 6:
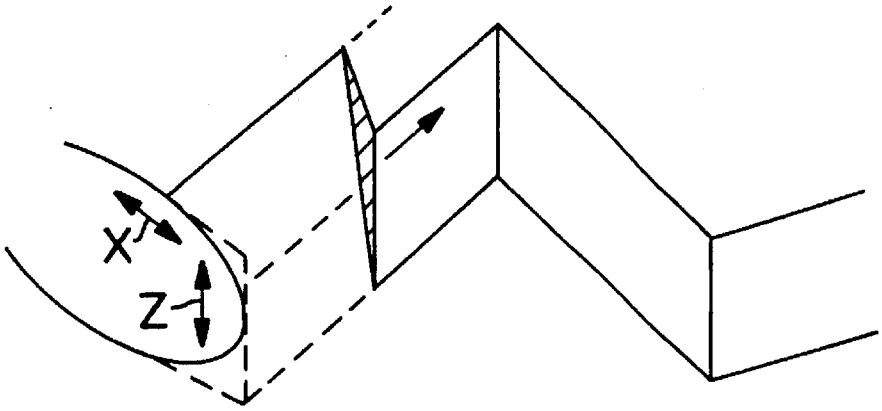
FIG. 6 is a diagram showing the portions of the wafer to be removed in another embodiment.

This embodiment has been portrayed as representing a case in which the chamfering work of the whole notch 24 is effected by moving the grindstone 16 in the direction of a wall thickness of the wafer 12 (the direction indicated by the arrow Z) while performing the chamfering work in the direction of length of the inner periphery of the notch 24. In this embodiment, chamfering is first performed starting at one end of the notch from the upper surface to the lower surface by relatively moving the grindstone in the direction denoted by bidirectional arrow X, and in the thickness direction denoted by bidirectional arrow Z as illustrated in FIG. 6. The grindstone is then moved incrementally along the inner periphery of the notch as denoted by the unidirectional arrow in order to change the chamfering position, followed by chamfering from the upper surface to the lower surface of the wafer, i.e. in the X and Z directions. This procedure is repeated to the other end of the notch. In other words, the grindstone completes multiple passes in the Z directions while incrementally moving along the inner peripheral surface after each pass in the Z direction. In this embodiment, the motor 36 is indexed to move the grindstone incrementally along the inner periphery of the notch after each pass at the X and Z axis. It is also noted, that since the surface of the grindstone is aligned with a line passing through the center of the wafer, the inner surface of the notch is not normal to the cross sectional surface of the edge of the notch being ground cross-hatched (See FIG. 6 attached hereto).

The chamfering work may be optionally carried out by moving the grindstone 16 and the wafer 12 in the direction of length of the inner periphery of the wafer 12 while continuing the chamfering work in the direction of wall thickness of the notch 24.

Figure 5:
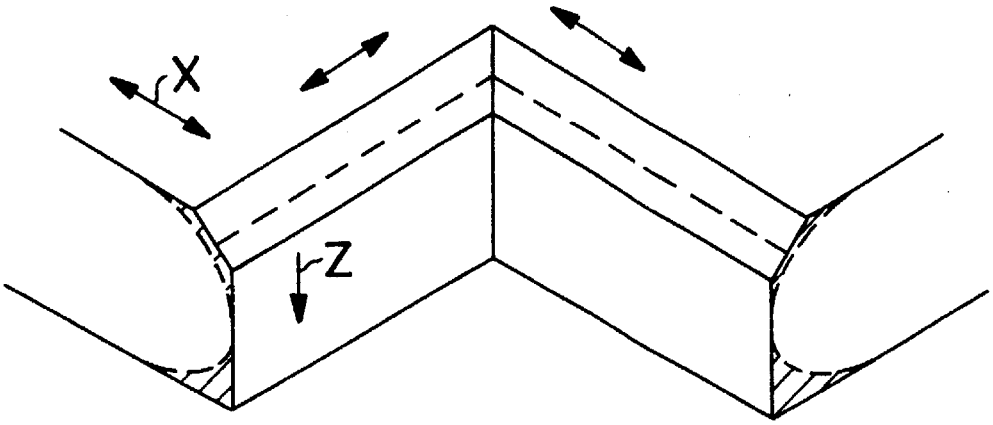
FIG. 5 is a diagram showing the portions of the wafer to be removed in the embodiment.

According to this optimal embodiment, the chamfering is first carried out from one end to the other of the notch along its inner periphery as illustrated in FIG. 5, with bidirectional arrows in the X direction and the inner-peripheral direction. The grindstone is then moved in the wafer thickness direction (denoted with unidirectional arrows Z in FIG. 5), followed by chamfering from one end to the other of the notch along its inner periphery. Thus, the grindstone is incremented in the Z direction after each pass along the inner peripheral surface. This procedure is repeated from the upper surface to the lower surface of the wafer in the thickness direction. These multiple passes of the grindstone are made in the inner peripheral direction as the grindstone is moving in the direction after each pass. FIG. 5 shows the intermediate chamfered and other portions as cross-hatched which will be subsequently chamfered. The relative movement of the grindstone and the wafer can be clearly seen from FIG. 5.

In this embodiment, The motor 48 is indexed to move the grindstone incrementally in the Z directions after each pass along the inner peripheral surface.

To be specific, the wafer 12 is moved in the direction of the arrow X and the grindstone 16 is moved in the direction of the arrow Z to perform the chamfering work on a whole profile of the direction of thickness of the notch 24 by driving and controlling the profiling mechanism 26 and the third drive mechanism 22 and, at the same time, the wafer 12 is slowly rotated around the central axis thereof (in the direction of the arrow Θ) by rotating and driving the pulse motor 36 at an appreciably low speed. As a result, the grindstone 16 is enabled to continuously chamfer the notch 24 in the circumferential direction thereof while chamfering the notch 24 in the direction of the wafer thickness.

Figure 4:
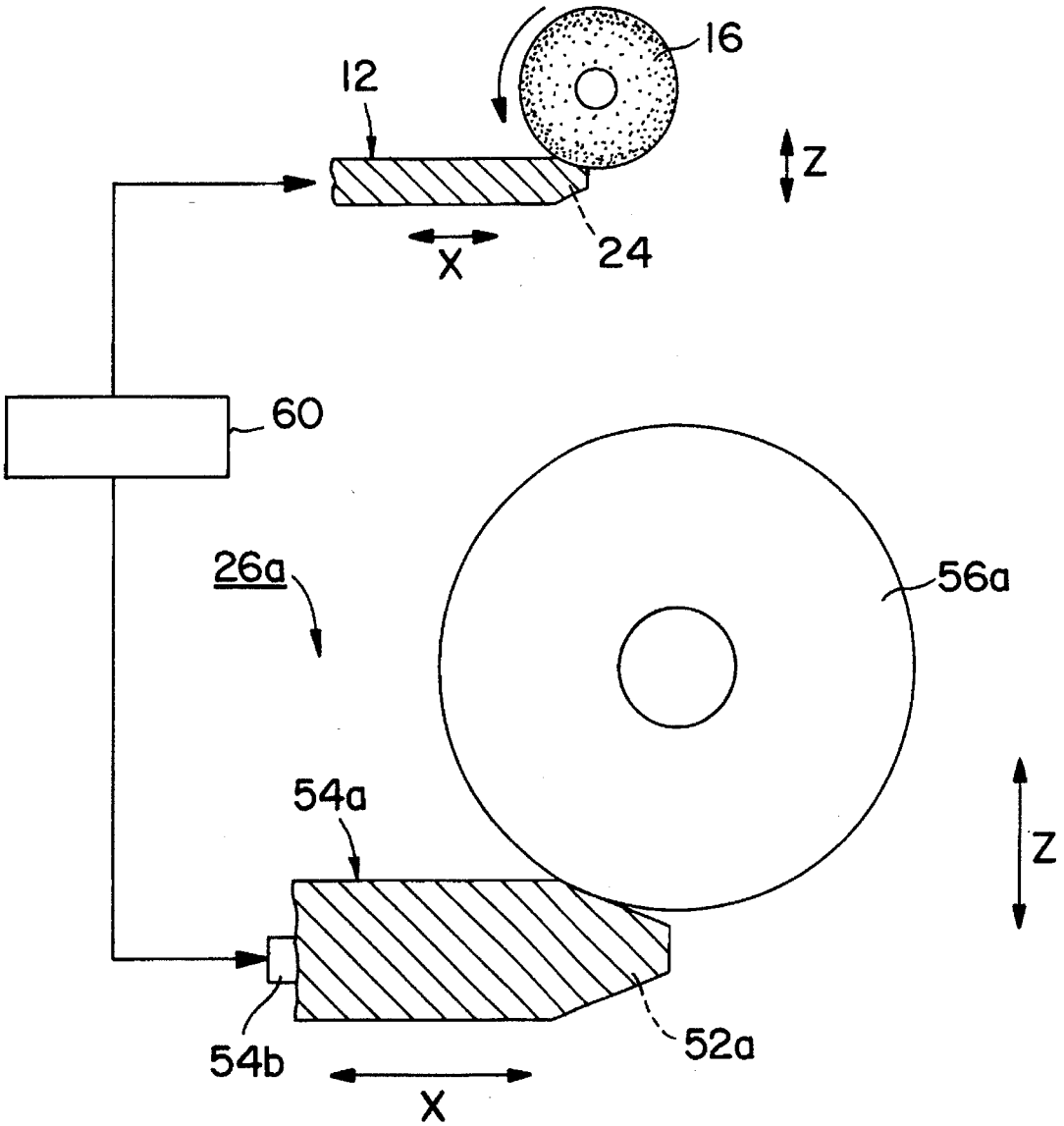
FIG. 4 is an explanatory diagram illustrating another profiling mechanism.

FIG. 4 illustrates a profiling mechanism **26*a* of another operating principle. This profiling mechanism 26*a* is provided with a reference plate 54 measuring a prescribed multiple of the size of the wafer 12 and disk 56*a* measuring a prescribed multiple of the size of the grindstone 16. The status of motion of the reference plate 54*a* and disk 56*a* is introduced via a detector not shown in the diagram into an action reducing device 60 to be stored therein. The first drive mechanism 15 to the third drive mechanism 22** are driven and controlled on the basis of the information so stored.

By the use of the reference plate 54 of a size which is the prescribed multiple of the size of the wafer 12, a groove 52 corresponding to the notch 24 of an appreciably small size can be magnified and formed on the reference plate 54 and the groove 52 can be imparted with high accuracy. This fact has an advantage in that the wafer 12 and the grindstone 16 can be guided with added accuracy and the notch 24 of this wafer 12 can be chamfered with high accuracy through the medium of the profiling mechanism **26*a* which is furnished with the magnified reference plate 54 and the disk 56**.

The apparatus of this invention for chamfering the notch of the wafer brings about the following effect.

The surface of the notch subjected to machining can be continuously and accurately positioned relative to the grinding surface of the grindstone because the first to third drive mechanisms are operated to move the grindstone and wafer relatively toward or away from each other under the guiding action of the profiling mechanism and, at the same time, rotate the wafer within a prescribed range of angle around the central axis thereof. As a result, the simple construction relying on the incorporation of the profiling mechanism enables the chamfering work to be performed accurately and efficiently on the notch of an appreciably small size in the circumferential direction and/or in the direction of thickness thereof. Further, the curved guide surface formed on the reference plate which is one component of the profiling mechanism allows the notch to be chamfered in the direction of thickness thereof and, at the same time, enables the angular parts formed by the chamfering work to be smoothly machined and prevents them from chipping.

What is claimed is:

1. An apparatus for chamfering a notch of a wafer by means of a profiling and grinding mechanism comprising:

a holding and rotation mechanism having a cylindrical part rotatable within a predetermined range of angle about its rotational axis perpendicular to a main surface of a wafer which can be mounted on a top surface of the cylindrical part by means of a first drive mechanism, said cylindrical part being coaxially provided with a reference plate having a chamfering guide surface at its peripheral edge which is located at a certain distance from an upper end of the cylindrical part, the wafer to be treated being fixed by vacuum attraction at an upper end of the cylindrical part;

a chamfering device comprising a motor, a disc-shaped grindstone rotated by means of the motor and a disc having a same diameter and a same thickness as the grindstone, the grindstone and the disc being arranged in a same plane in order that a line connecting center points of same side surfaces of the grindstone and the disc is parallel to the rotational axis of the cylindrical part and that the distance between center points of the grindstone and the disc is equal to the distance between upper surfaces of a wafer and a reference plate mounted on the cylindrical part;

a second drive mechanism for moving the holding and wafer rotation mechanism relative to the grindstone in a radial direction of the grindstone;

a third drive mechanism for moving the holding and rotation mechanism relative to the grindstone in a direction of thickness of a wafer on the holding and rotation mechanism; and a positioning mechanism for controlling the first and third mechanisms in order to relatively move the disc in contact with a chamfering guide surface so that, at the same time, the grindstone comes in contact with the notch of the wafer in order to chamfer the notch in accordance with the motion of the disc relative to the chamfering guide surface, and to duplicate the geometry of the chamfering guide surface on the notch.

2. An apparatus according to claim 1 wherein the chamfering guide surface is curved along the thickness direction of the reference plate.

3. A method of chamfering a notch of a wafer by controlling the operation of a disc Shaped rotational grindstone by means of a profiling control mechanism, said control mechanism comprising:

a holding and rotation mechanism for holding and rotating the wafer around the central axis normal to a principal surface of the wafer within a predetermined range of angle;

a reference plate having a diameter and a thickness same as a similar enlargement of the wafer and a chamfering guide surface same as a similar enlargement of a surface to be formed on the notch by the chamfering at the same enlargement factor as the reference plate; and a disc having a predetermined diameter and a predetermined thickness, said method comprising the steps of:

fixing the wafer to the holding and rotation mechanism;

rotating the wafer within the predetermined range and the reference plate within the same range as the wafer and at the same time moving the disc in the thickness direction of the reference plate and the direction parallel to a surface of the reference plate in order that the outer periphery of the disc makes contact with the reference plate;

detecting the direction and the amount of the motion of the disc making contact with the chamfering guide surface;

decreasing detected data by a factor of the inverse of an enlargement factor; and chamfering the notch of the wafer by contacting the outer periphery of the grindstone with the notch in accordance with decreased data.

4. An apparatus for chamfering a notch of a wafer by means of a profiling and grinding mechanism comprising:

a holding and rotation mechanism having a cylindrical part having a rotation axis and an upper end which is rotated within a predetermined range of angle by means of a first drive mechanism, and coaxially provided with a reference plate having a chamfering guide surface at its peripheral edge which is located at a certain distance from an upper end of the cylinder, the wafer to be treated being fixed by vacuum attraction at an upper end of the cylindrical part having an upper end;

a chamfering device comprising a motor, a disc-shaped grindstone rotated by means of the motor and a disc having a diameter and a same thickness as the grindstone, the grindstone and the disc being arranged in a same plane in order that a line connecting center points of same side surfaces of the grindstone and the disc is parallel to the rotational axis of the cylindrical part and that the distance between center points of the grindstone and the disc is equal to the distance between an upper end of the cylindrical part and the upper end of the rotary stand;

a second drive mechanism for moving the holding and wafer mechanism in a radial direction of the cylindrical part;

a third drive mechanism for moving the holding and rotation mechanism in a direction perpendicular to the rotational axis of the cylindrical part in order that the holding and rotation mechanism and the grindstone move toward and away from each other; and a signal generating means for controlling the third drive mechanism in order to relatively move the disc in contact with the chamfering guide surface so that the grindstone comes in contact with the notch of the wafer in accordance with the motion of the disc relative to the chamfering guide surface, and duplicates the geometry of the chamfering guide surface on the wafer.

5. An apparatus according to claim 1 wherein the chamfering guide surface is curved along the thickness direction of the reference plate.

* * * * *